US008572883B2

(12) United States Patent
Markle

(10) Patent No.: US 8,572,883 B2
(45) Date of Patent: Nov. 5, 2013

(54) PULL-THRU FIREARM CLEANING SYSTEM AND METHOD

(75) Inventor: Ronald W. Markle, West Salem, WI (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 13/300,269

(22) Filed: Nov. 18, 2011

(65) Prior Publication Data

US 2013/0125925 A1 May 23, 2013

(51) Int. Cl.
*B08B 9/38* (2006.01)

(52) U.S. Cl.
USPC ..... 42/95; 15/104.062; 15/104.2

(58) Field of Classification Search
USPC ..... 42/95; 15/104.062, 104.066, 104.067, 15/104.068, 104.069, 104.165, 104.2
See application file for complete search history.

(56) References Cited

U.S. PATENT DOCUMENTS

| | | | | | |
|---|---|---|---|---|---|
| 1,591,425 | A | * | 7/1926 | Kingman | 15/229.11 |
| 2,798,238 | A | | 7/1957 | Rogovin | |
| 2,862,218 | A | * | 12/1958 | Krone | 15/104.16 |
| 2,897,525 | A | | 8/1959 | Goodwin et al. | |
| 3,398,417 | A | | 8/1968 | Erwin | |
| 4,399,627 | A | | 8/1983 | Malesky et al. | |
| 4,716,673 | A | * | 1/1988 | Williams et al. | 42/95 |
| 5,074,074 | A | | 12/1991 | Yeadon | |
| 5,171,925 | A | | 12/1992 | Mekler | |
| 5,588,242 | A | | 12/1996 | Hughes | |
| 5,871,589 | A | | 2/1999 | Hedge | |
| 5,934,000 | A | | 8/1999 | Hayes, Sr. | |
| 5,983,550 | A | | 11/1999 | Skaar | |
| 6,077,817 | A | | 6/2000 | Pomp | |
| 6,630,034 | B1 | | 10/2003 | Schnell | |
| 6,640,480 | B2 | | 11/2003 | Williams et al. | |
| 7,278,358 | B2 | | 10/2007 | Huffman | |
| 7,356,961 | B2 | | 4/2008 | Williams | |
| 2006/0147247 | A1 | | 7/2006 | Whipple | |
| 2006/0162223 | A1 | | 7/2006 | Whipple | |
| 2011/0083354 | A1 | | 4/2011 | Krieger | |
| 2011/0107646 | A1 | | 5/2011 | Anderson | |

FOREIGN PATENT DOCUMENTS

WO WO 2010/037047 A1 4/2010

OTHER PUBLICATIONS

Pull-Thru Cleaning Kits, Gunslick Pro Precision Gun Care, 2011 Catalog, 1 page.
Snap-N-Pull Quick Barrel Cleaning System, Gunslick Pro Precision Gun Care, 2008 Catalog, 1 page.

(Continued)

*Primary Examiner* — Stephen M Johnson
(74) *Attorney, Agent, or Firm* — Christensen Fonder P.A.

(57) ABSTRACT

A firearm cleaning device comprises a flexible cable and threaded coupling assembly, to which a plurality of components may be attached individually or in combination for optimal configuration based on cleaning need and firearm type. A spear-point piercing adapter may be threadably attached to a cable with a coupling portion fixed thereto. The piercing adapter includes a threaded shank with a sharp tip, on which a cleaning patch is speared and a jag is threadably attached thereto, thereby sandwiching the cleaning patch between a body of the piercing adapter and the jag. The cleaning device and various components and attachments can be packaged and sold as a single compact device, which provides mobility for field use, configurability for use with a wide range of firearm types, and cost savings due to fewer components and reduced packaging size.

7 Claims, 3 Drawing Sheets

(56) References Cited

OTHER PUBLICATIONS

AR-15 Kit and Police Pro-Pack, Gunslick Pro Precision Gun Care, 2008 Catalog, 1 page.
Snap-N-Pull Quick Barrel Cleaning System, Gunslick Pro Precision Gun Care, 2007 Catalog, 1 page.
Gun Cleaning Article, Ted's Home Page, 10 pages.
Gun Cleaning Rods, Jags, and Patches, E. Arthur Brown Company, 2 pages.
Pro Shot Tactical Gun Cleaning Kits—Pull Thru Brush and Jag, E. Arthur Brown Company, 1 page.
Disposable Pull Thru Kits, Outer's, The Gunner's Companion, 1 page.
Tactical Pull Through System, Proshotproducts.com, 2 pages.
PTK12, Proshotproducts.com, 1 page.

* cited by examiner

PULL-THRU FIREARM CLEANING SYSTEM AND METHOD

FIELD OF THE INVENTION

The present invention relates generally to apparatuses and methods for cleaning firearms, and more particularly, to a configurable pull-thru firearm barrel cleaning system that captures a cleaning patch.

BACKGROUND

When a firearm is discharged, small amounts of debris and residue are deposited on the surface of the barrel bore. Additionally, the bore may become fouled with dirt or other debris during normal field use, and corrosion may accumulate during storage. Operating a firearm with a dirty barrel can compromise accuracy, safety, and can permanently damage firearm components. Thus, it is imperative that firearms are thoroughly cleaned to maintain consistent and safe operation.

Firearm barrel cleaning devices generally comprise either a rigid rod or a flexible cable, to which cleaning implements are attached. Generally, firearm barrel cleaning often involves first removing the barrel from the receiver and moving the cleaning device (e.g., rod or cable), to which one or more cleaning implements are attached (e.g., brushes or patches) through the barrel. This process is generally repeated, and implements may be changed between cleaning steps, until the barrel is sufficiently clean.

Present cleaning devices have a number of shortfalls such as inconvenient firearm disassembly requirements, ineffective cleaning performance, lack of portability, and/or damaging usage. Rigid rod-type cleaning devices in particular, exhibit many such shortfalls.

First, the barrel of many firearms must be removed before breech-to-nozzle cleaning can be done with a rigid rod-type device. Some individuals choose to clean firearms in a nozzle-to-breech direction which does not require barrel removal; however, this method may undesirably push some debris into the receiver.

Secondly, rigid rod-type devices generally require a bore guide and/or chamber guide to be used to prevent the cleaning device from damaging the firearm. A bore guide is used for nozzle-to-breech cleaning in order to align the rod in the center of the bore, which prevents the rod from flexing and scratching the bore, or from scratching the bore crowning when the rod is removed. A chamber guide is simply used to prevent the cleaning rod from extending into and damaging the chamber.

Thirdly, rigid rod-type devices are not convenient for cleaning during normal field use. As stated above, rods may require a user to carry bore guides and/or chamber guides. Further, rigid rods cannot be disassembled and transported conveniently. Segmented rods exist that have attempted to remedy this shortfall; however, these rods are known to be prone to flexing and breaking during use and require some effort to assemble.

Flexible cable cleaning devices are also utilized instead of rigid rod-type devices. Cable-type devices are flexible, which allows for convenient storage and portability. Further, the flexible nature of cables allows many such systems to be utilized for breech-to-nozzle pull-thru cleaning. Some cable systems allow a user to configure the device to clean different sized-barrels changing cleaning implements. Cable inherently does not work well for pushing cleaning implements through the barrel due to the flexing of the cable when there is resistance in pushing the cleaning implement through the barrel.

Despite improvements, current firearm cleaning devices provide inefficient and/or less than optimal cleaning due to existing cleaning implements. For example, cleaning patches are attached to a cleaning rod or cable by utilizing either a loop or a jag, and a cleaning solvent is typically applied before usage. Cleaning loops comprise a slotted member, in which a cleaning patch is partially inserted. The loop is then pushed or pulled through the bore, during which the cleaning patch removes debris from the bore. One substantial shortfall of cleaning loops is that they provide uneven contact between the patch and the bore, due to the way in which a patch must be folded or otherwise bunched up, and inserted through the loop. Accordingly, loops provide inconsistent cleaning and may require more cleaning passes to properly clean a firearm barrel. Particularly, where a cleaning patch is pushed through with a jag rearward of the patch, the patch will not have an even circular draping over the jag due to the patch being attached by way of threading through the loop.

Jags are also currently utilized in both cable and rod-type systems. Jags may include a sharp tip to pierce a cleaning patch; as such, they are often referred to as spear-point jags. Spear point jags provide more consistent cleaning as compared to loops. Since such jags pierce the center of the patch and the diameter of the jag is dimensioned slightly smaller than the inner diameter of the firearm bore, the front side of the cleaning patch provides a consistent cleaning surface against the bore as the patch evenly drapes over the jag. Spear point jags do not secure the cleaning patch onto the spear point and as such are designed for push-through operation only and the cleaning patch falls off of the jag after it is pushed through the barrel. The cleaning device must then either be pulled back through the barrel, or pushed all the way through the end of the barrel, without the patch and without effecting any cleaning during that stroke. Either operation requires care, as it provides additional opportunity for the barrel to become damaged and is inefficient.

As such, there is a need for a configurable firearm cleaning device that is portable, readily secures cleaning patches thereto, that provides an even draping over jags, that is capable of push and pull cleaning, and breech-to-nozzle cleaning without substantial firearm disassembly.

SUMMARY

A reconfigurable firearm cleaning system that provides improved firearm cleaning performance and ease of use. According to an embodiment of the invention, the system includes a flexible cable, the cable having a handle end and an attachment end with having threaded coupling portion, a plurality of cleaning patches, and a plurality of attachments connectable with threaded couplings. One such attachment includes a coupling portion having a spear point on a threaded male coupling portion that pierces a cleaning patch and that connects to a female coupling portion to retain the patch thereon, the patch being captured within the connection defined by the threaded male coupling portion and the female coupling portion. In embodiments the connection will having opposing confronting surfaces that pinch or clamp the patch therebetween, securing the patch within the connection.

An embodiment of the invention is a firearm cleaning system including a elongate member for extending through barrels and attachment to barrel cleaning implements, a plurality of barrel cleaning implements including a component having a threaded male coupling portion with a spear point thereon.

The component may be a jag, an adaptor with opposing coupling portions on each end, or other component. Directions for use may accompany the system.

In an embodiment the female coupling portion that connects to the threaded male coupling portion with a spear point may be part of a jag. A number of jags of different diameters may be provided that correlate to different barrel sizes. The threaded male coupling portion may be part of an adapter that has on the end opposite the threaded male coupling portion with the spear point, another threaded coupling that connects to the elongate member. The threaded coupling on the adapter opposite the spear point may also be a threaded male coupling portion, and of a larger diameter than the threaded male coupling portion with the spear point. The smaller diameter threaded male portion with the spear point provides easy piercing of the cleaning patches. The cable assembly and various components and attachments can be packaged and sold as a single kit, which provides mobility for field use, configurability for use with a wide range of firearm sizes, and cost savings due to fewer components and reduced packaging size.

In an embodiment of the invention, a piercing adapter comprises a first male coupling portion, a body portion having a generally cylindrical body, and a second male threaded portion with a spear point tip. The body, may have features formed therein, such as knurling for gripping by a user to facilitate tightening. The cross-sectional diameter of the second threaded male coupling portion may be smaller than that of the first threaded male coupling portion, the first threaded male coupling portion which may attach to an elongate member for extending cleaning implements through the barrel.

In an embodiment of the invention, a barrel cleaning device has a cable with a plurality of connecting members attached to an end thereof. One of said connecting members connected to another connecting member has a threaded male coupling portion with a spear point on an end of said male coupling portion. Said male portion may pierce cleaning patches and then connect to a member with a cooperating female coupling portion to sandwich, pinch, or clamp the patch between the respective members.

In an embodiment of the invention, a fire arm barrel cleaning device comprising a cylindrical body and a male threaded coupling portion extending therefrom and having a sharp spear point for piercing a cleaning patch. Directions for use may accompany the device, in particular piercing cleaning patches with the male threaded coupling portion.

The present invention provides significant performance advantages over prior art spear-point jags, namely, the point and shank of the present invention create a relatively small hole when piercing a cleaning patch, and then clamps the patch in the region around the relatively small hole. The small hole minimizes tearing and bunching of the patch at the hole facilitating uniform clamping around the circumference of the shank and more secure attachment. In embodiments, the piercing adapter may attach to the fitting on the cable with a larger diameter male/female threaded coupling providing a connection easier to connect due to the larger threaded member sized and stronger and more secure due to the larger threaded member size. Other attachments, such as brushes, that may subject the assembly to greater tension stresses, also then may be sized to utilize the larger threaded male female threaded coupling.

The cleaning device of embodiments of the present invention may include a plurality of cleaning jags, each sized for cleaning a particular caliber firearm, wherein the outer diameter of the jag is slightly smaller than the inner bore diameter of the respective firearm barrels. The plurality of cleaning jags each having the same size of female threaded coupling portion. The jags connect to an adapter that has a threaded spear point male coupling portion and a coupling portion that then mates with a coupler portion on an end of an elongate through barrel insertion member. A jag is threadably coupled to the threaded shank of the male coupling portion of a spear-point adapter, and sandwiches the cleaning patch between the adapter and the jag, thereby holding the patch in place during cleaning operations. This allows a user to utilize a single cleaning kit to clean a wide variety of firearms.

A feature and advantage of embodiments of the invention is that the patch stays attached as part of the gun cleaning apparatus for pushing the patch through the barrel and pulled back through the barrel. When pushed, the patch is draped over a member proximal to the elongate through barrel insertion member and toward the handle end of the through barrel insertion member. The patch is exposing a first side. As the patch is pushed through a barrel in a cleaning stroke and out of an end of the barrel, and then pulled back into the barrel, the patch may flip to expose the opposite unused second side of the patch which may then evenly drape over a jag or other connecting member thereby providing another cleaning stroke when pulled back through.

Configuration of the present invention may be more cost-effective than existing firearm cleaning devices. Since the piercing adapter and jag and which secure the cleaning patch are threadably attached to the cable fitting, they can be easily removed and other cleaning implements such as brushes or other accessories can be utilized. Furthermore, efficiency is realized by particular embodiments of the invention in that a plurality of different sized jags may be used with a single sized piecing coupling.

DETAILED DESCRIPTION OF THE DRAWINGS

Figure 1A:
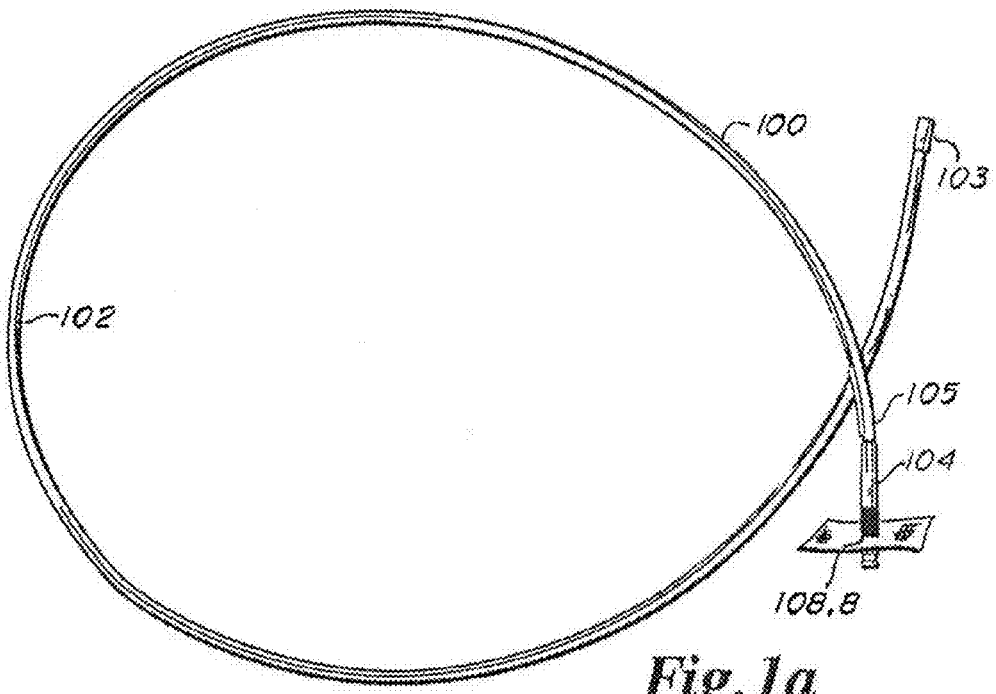
FIG. 1*a* is a view of a firearm cleaning device as fully assembled, according to an embodiment of the present invention.
Figure 1B:
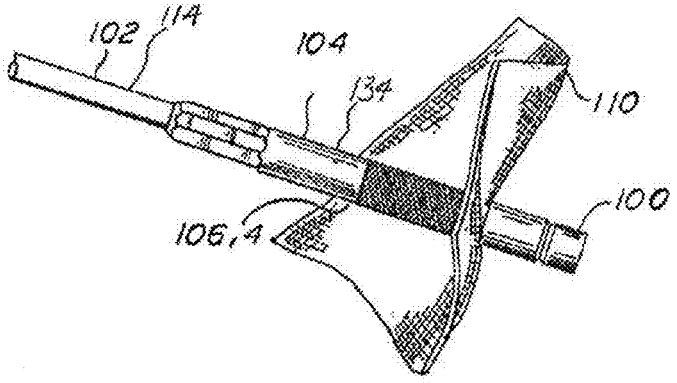
FIG. 1*b* is a detail view of the attachment end of the cable with attachments of the firearm cleaning device of FIG. 1*a;*
Figure 2:
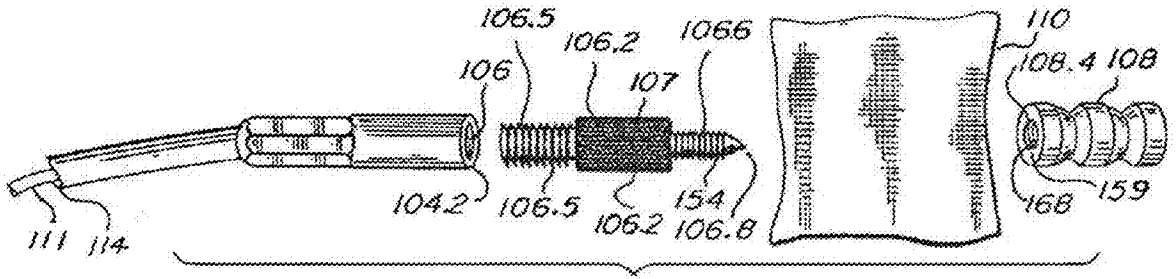
FIG. 2 is a detail view of the components of FIG. 1*b* in a disassembled state.

A firearm cleaning device assembly 100 according to one embodiment of the present invention is depicted in FIGS. 1*a* and 1*b* in its fully assembled state and with components separated in FIG. 2. The cleaning device assembly 100 generally comprises an elongate through barrel insertion member 102 configured as a flexible cable to which a plurality of components are connected in order to clamp cleaning patch 110 and/or other suitable cleaning devices, which facilitate the cleaning operation of a wide range of firearm barrel sizes.

The flexible cable 102 has a first end 103 and a second end 105 with a fitting 104 having a female threaded coupling portion 104.2 fixably attached thereto. The female threaded coupling portion is a threaded bore 106. Another component, configured as a piercing adapter 107, has a body 106.2, a male threaded coupling portion 106.5 extending from the body, and screwed into the fitting 104 forming a connection 106.4 at one end of the component. At the other opposite end of the component, extending from the body, is another threaded male coupling portion 106.6 with a spear point 106.8. A cleaning patch 110 is pierced by the threaded male coupling portion 106.6, and a jag 108 with a female threaded coupling portion 108.4 is screwed onto same clamping the cleaning patch therebetween at a second connection 108.8. The fitting 104, piercing adapter 107, and jag 108 are all coaxial.

Flexible cable 102 is an elongated, flexible member, which can comprise one or more polymers, elastomers, metals, fibers, and/or other suitable materials. In an embodiment, a steel wire cable 111 will have a coating 114 such as a polymer. The flexible nature of cable 102 allows it to be wound in a small form factor for storage and/or transportation, and also allows it to be fed into the breech end of certain firearm barrels without having to remove the barrel from the firearm.

Material selection of the present invention is important, as the device should be durable enough to maintain effective and consistent operation, yet must not scratch, mar, or otherwise damage the bore of a firearm barrel when used. According to an embodiment of the present invention, components other than flexible cable 102 and cleaning cloth, including fitting 104, piercing adapter 107, and jag 108, may be comprised substantially of brass. Brass is selected as a component material because it is sufficiently rigid to be manufactured to tight dimensional tolerances to facilitate effective cleaning; however, brass is softer than substantially all firearm barrel materials, which facilitates cleaning without damaging the bore of a firearm barrel. Alternatively, such components may comprise any other suitable materials that ensure consistent yet non-damaging operation, including but not limited to metals and/or polymers, or a combination of the same. Such components may also be plated or coated to protect from corrosion, for example, due to particular cleaning fluids or solvents or moisture. Cleaning patch 110 may comprise cotton or synthetic cloth or other suitable material, typically an absorbent material.

Fitting 104 comprises an elongated member that is fixably connected coaxially to flexible cable 102, such as by crimping. Fitting 104 can comprise one or more portions, such as hexagonal cross-sectional portion 132 crimped on the cable, and/or circular cross-sectional portion 134 which has the threaded bore. A flat side surface profile such as hexagonal portion 132, for example, may facilitate a user's ability to tighten piercing adapter 107 to fitting 104. Inner bore 106 of fitting 104 is threaded to accept threaded spear point 106.8 of piercing adapter 107.

Figure 4:
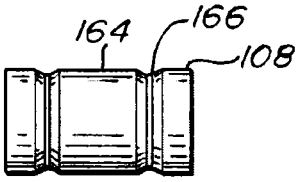
FIGS. 4-8 depict a plurality of jags, each of which is sized for usage in a particular caliber firearm, according to an embodiment of the present invention.
Figure 5:
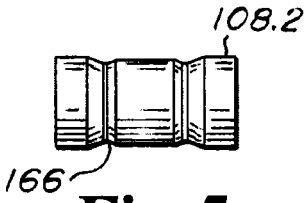
Figure 6:
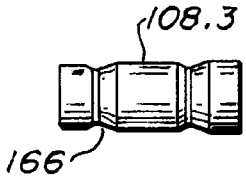
Figure 7:
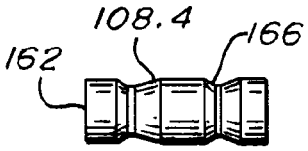
Figure 8:
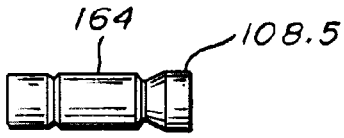
Figure 3:
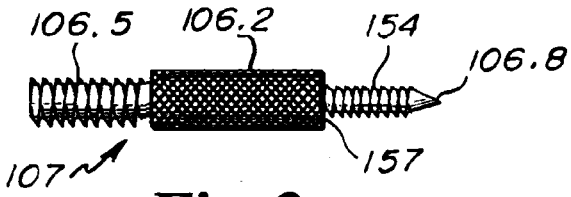
FIG. 3 depicts a piercing adapter, according to an embodiment of the present invention.
Figure 12:
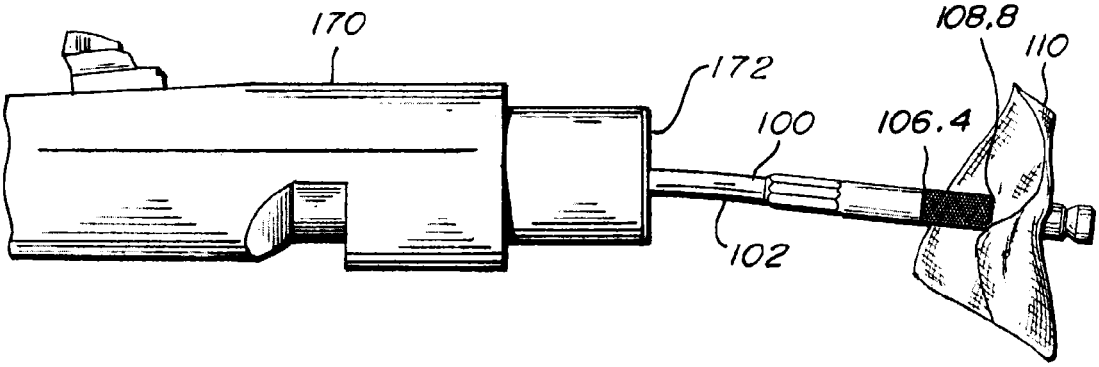
FIG. 12 is a partial perspective view of a firearm cleaning device partially inserted through the breech end of a firearm barrel, wherein the barrel has been removed from the receiver of the firearm, depicting a usage of an embodiment of the present invention.

Referring now to FIG. 3, piercing component 107 comprises threaded male coupling portion 106.5, body 106.2, threaded shank 154, and sharp point 106.8, all of which are coaxial. male threaded coupling portion is sized and threaded to match threaded bore 106 of fitting 104, so that piercing adapter 107 can be threadably, yet removably attached to fitting 104. Body portion 106.2 provides a surface that a user can grip to tighten piercing adapter 107 to fitting 104. Such surface may, as in the present embodiment, be knurled or otherwise treated or shaped to facilitate improved grip while tightening. Shank 154 is sized and threaded to match threaded bore 168 of jag 108, so that jag 108 can be threadably, yet removably coupled to piercing adapter 107 (FIG. 4). Shank 154 coalesces to form tip 106.8, which can easily pierce cleaning patch 110 prior to coupling the piercing adapter 107 to jag 108.

Figure 11:
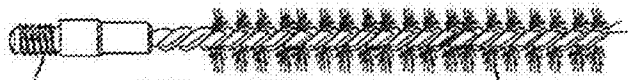
FIG. 11 depicts a cleaning brush attachment for the fitting according to an embodiment of the invention.

FIGS. 4-8 depict a plurality of jags 108.1, 108.2, 108.3, 108.4, 108.5, each of which is sized for use in cleaning a specific caliber firearm barrel. The jags comprises an elongated cylindrical member, with an outer surface 164 and having a diameter A, which is slightly smaller than the inner diameter of the firearm bore for which the jag 108 is designed to clean. More specifically, referring to FIG. 9, the diametric size of the jag is configured to compress the cleaning patch between the jag outer surface and the barrel for effective cleaning. The smallest jag may be approximately the same diametric size as the fitting and/or piercing adapter and then the other jags will be of greater diametric size. The jags 108 may include one or more circumferential grooves or recesses 166. Such grooves 166 aid in the cleaning action and facilitate the trapping of debris while cleaning device 100 is being pulled through a firearm barrel. The inner bore 168 of jags 108 is threaded to accept the threaded shank 154 of the piercing adapter 107. In an embodiment, the size of the threaded male coupling portion and the bore of the fitting is larger than the threaded shank and threaded bores of the jags. This permits easy piercing of the cleaning patches with the smaller diameter shank and also permits attachment of the piercing adapter and other attachments, such as brushes to the cable fitting with ease and resulting in a very secure connection. See FIG. 11 with a brush 172 having a threaded connection nipple 174 also sized for the threaded bore 106 of the fitting 104.

In embodiments of the invention, a cable is connectable to an intermediate member at a first threaded connection 106.4 comprising a first threaded male portion 106.5 of a first radial size and a cooperating threaded female portion 104.2 with the male portion being on one of the cable and intermediate member, the female portion being on the other of the cable and intermediate member, the intermediate member is further connectable to one of a plurality of jags of different sizes by way of a second threaded connection 108.8, the second threaded connection including a threaded male portion 106.6 with a pointed piercing end 106.8 and a threaded female portion 108.4, one of the threaded male portion being on the intermediate member and the other of the male portion and female portion being on the one of the plurality of jags. The male portion of the second threaded connection may have a diameter smaller than that of the male portion of the first threaded connection. The plurality of jags all having the same size threaded connection portions. In embodiments of the invention, additional components, including at least one brush have threaded connection portions of the same size.

Figure 9:
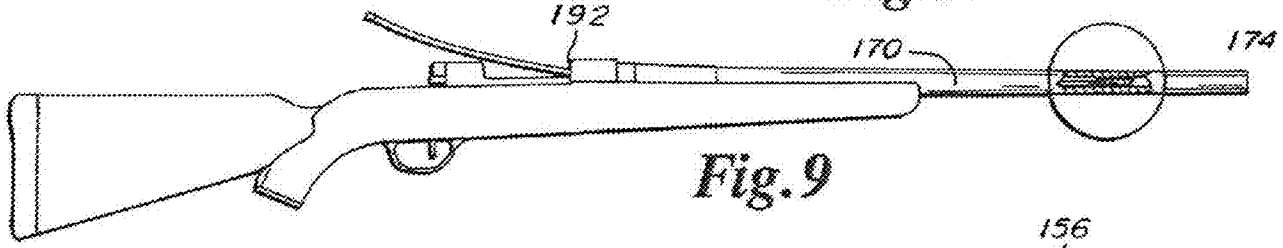
FIG. 9 depicts a side elevational view and partial cross sectional of a firearm cleaning device assembly in a firearm, according to an embodiment of the present invention.
Figure 10:
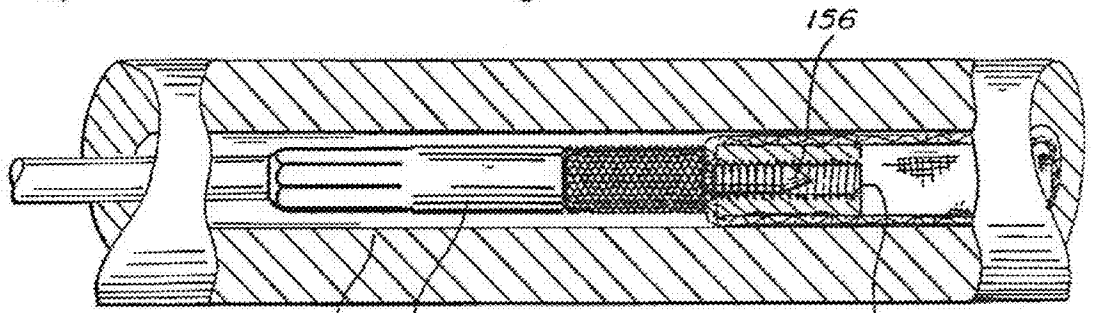
FIG. 10. depicts a close up cross sectional view of FIG. 9.

Referring to the figures generally and specifically, FIGS. 2, 9, and 10, in operation, a user first attaches a piercing adapter 107 to the cable/coupling assembly 130 by threading the jag male threaded coupling portion 106.5 into the coupling bore 106. A cleaning patch 110 is then pierced by the tip 106.8 and pushed onto the shank 154 of the piercing adapter 107. The user then selects a jag 108 to match the caliber of firearm that is to be cleaned. The jag 108 is then threaded onto the shank 154 of the piercing adapter 107, sandwiching and clamping the cleaning patch 110 between a stop surface 157 of the piercing adapter 107 and stop surface 159 of the jag 108. A suitable cleaning solvent, such as Gunslick Pro Ultra-Klenz®, may then applied to the cleaning patch 110.

Next, the end of the cable 102 opposite the cleaning patch 110 is inserted into the breech end 172 of the firearm barrel 170. The user then pulls the cable 102 through the entire firearm barrel 170 so that cleaning device 100 moves in the breech-to-nozzle direction and exits the nozzle 174 of barrel 170. This process is then repeated until firearm barrel 170 is sufficiently clean. Cleaning patch 110 can be flipped prior to a subsequent cleaning operation in order to utilize the unused side of patch 110, or a fresh cleaning patch 110 can be utilized. Furthermore, brushes or other cleaning implements can be attached to cable/coupling assembly 130 for one or more of the cleaning operations, as needed. Alternatively, the end with the cleaning patch can be inserted into the breech end and through the barrel where the patch end extends out of the barrel, the patch can then be situated to lay over the jag that is sized to the barrel size; this will typically occur automatically as the patch is pulled back through the barrel toward the breech end. It is also possible to utilize cleaning device 100 for nozzle-to-breech cleaning.

Particular portions of the invention and particular embodiments of the invention may be used in association with other known components of prior art cleaning apparatus. The following patents or patent publications are incorporated by reference herein: U.S. 2007/0266610; U.S. 2006/0147247; U.S. Pat. Nos. 4,716,673; 5,074,074; 7,356,961. For example, the piercing adapter by itself or with assorted jags may be utilized with other existing gun kits or gun kit components as supplemental pieces. Also the rigid tubes or rods may in some cases be substituted for the flexible cable while still retaining certain advantages.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

I claim:

1. A gun barrel cleaning apparatus that captures cleaning patches, the apparatus comprising:

a flexible cable, the cable having a handle end and an attachment end, the attachment end having a coupling portion with a threaded bore;

a piercing adaptor comprising a body portion with a threaded male coupling portion extending from a first end and a threaded male coupling portion with a spear point extending from the opposite second end, the threaded male coupling portion extending from the first end sized to couple with the threaded bore of the coupling portion of the flexible cable, the piercing adapter having an external knurled surface;

a jag having a threaded female coupling portion sized to couple with the threaded male coupling portion with the spear point, the jag having a plurality of circumferentially extending grooves therein; and a cleaning patch pierceable by the threaded male coupling with the spear point, whereby the cleaning patch may be piercingly attached to the piercing adaptor on the threaded male coupling portion with the spear point and may be captured thereon by threadingly attaching the jag to said threaded male coupling portion with the spear point.

2. A gun barrel cleaning apparatus that captures cleaning patches, the apparatus comprising:

a flexible cable, the cable having a handle end and an attachment end, the attachment end having a coupling portion with a threaded bore;

a piercing adaptor comprising a body portion with a threaded male coupling portion extending from a first end and a threaded male coupling portion with a spear point extending from the opposite second end, the threaded male coupling portion extending from the first end sized to couple with the threaded bore of the coupling portion of the flexible cable;

a set of jags, each of the set having a threaded bore sized to threadingly engage the threaded male coupling portion of the piercing adapter, and each member of the set having a different outer diameter from the other members of the set;

a cleaning patch pierceable by the threaded male coupling with the spear point, whereby the cleaning patch may be piercingly attached to the piercing adaptor on the threaded male coupling portion with the spear point and may be captured thereon by threadingly attaching one of the set of jags to said threaded male coupling portion with the spear point; and a plurality of brushes, each brush having a threaded shaft sized for being received in the coupling portion of the cable.

3. A firearm barrel cleaning device comprising:

a flexible cable having a first end and a second end;

a fitting fixably coupled to the second end of the flexible cable, the fitting having a female threaded coupling portion;

a piercing adaptor having a body with a knurled exterior surface and having a threaded male coupling portion configured to threadingly engage the female threaded coupling portion of the fitting, a body connecting to the threaded male coupling, and a threaded shank extending to a piercing point extending from the body, a cleaning patch that is pierceable onto the threaded shank of the piercing adapter; and a jag comprising generally an elongated cylindrical shape with a plurality circumferential extending grooves which is threadably coupleable to the threaded shank with the piercing point of the piercing adapter, thereby sandwiching the cleaning patch between the piercing adapter and a selected jag.

4. The firearm barrel cleaning device of claim 3, wherein the device comprises a plurality of interchangeable jags, each of which is dimensioned to clean a particular caliber firearm barrel.

5. A gun barrel cleaning apparatus that captures cleaning patches, the apparatus comprising:

a flexible cable, the cable having a handle end and an attachment end, the attachment end having a coupling portion with a threaded bore;

a piercing adaptor comprising a body portion with a threaded male coupling portion extending from a first end and a male coupling portion with a spear point extending from the opposite second end, the male coupling portion extending from the second end having threads commencing on said male coupling portion at a juncture with the body portion, the threaded male coupling portion extending from the first end sized to couple with the threaded bore of the coupling portion of the flexible cable;

a plurality of jags having a threaded female coupling portion sized to couple with the male coupling portion with threads at the second end with the spear point, the plurality of jags each having a plurality of circumferentially extending grooves therein; and a cleaning patch pierceable by the threaded male coupling with the spear point, whereby the cleaning patch may be piercingly attached to the piercing adaptor on the threaded male coupling portion with the spear point and may be captured thereon by threadingly attaching a selected one of the plurality of jags to said threaded male coupling portion with the spear point.

6. A gun barrel cleaning apparatus of claim 5 further comprising a plurality of brushes, each brush having a threaded shaft sized for being received in the coupling portion of the cable.

7. A gun barrel cleaning apparatus, the apparatus comprising:

a flexible cable, the cable having a handle end and an attachment end, the attachment end having a coupling portion with a threaded bore;

a piercing adaptor comprising a body portion with and knurled surface and with a threaded male coupling portion extending from a first end and a male coupling portion extending from the opposite second end, the male coupling portion extending from the second end having threads, the threaded male coupling portion extending from the first end sized to couple with the threaded bore of the coupling portion of the flexible cable;

a plurality of jags having a threaded female coupling portion sized to couple with the male coupling portion with threads at the second end, the plurality of jags each having a plurality of circumferentially extending grooves therein;

a cleaning patch pierceable by the threaded male coupling, whereby the cleaning patch may be piercingly attached to the piercing adaptor on the threaded male coupling portion t and may be captured thereon by threadingly attaching a selected one of the plurality of jags to said threaded male coupling portion with the spear point; and a plurality of brushes, each brush having a threaded shaft sized for being received in the coupling portion of the cable.

* * * * *

UNITED STATES PATENT AND TRADEMARK OFFICE

CERTIFICATE OF CORRECTION

PATENT NO. : 8,572,883 B2
APPLICATION NO. : 13/300269
DATED : November 5, 2013
INVENTOR(S) : Markle It is certified that error appears in the above-identified patent and that said Letters Patent is hereby corrected as shown below:

In the Claims

In Column 8, Line 33, Claim 3, delete “body,” and insert -- body; --, therefor.

In Column 9, Line 6, Claim 6, delete “A gun” and insert -- The gun --, therefor.

In Column 10, Line 13, Claim 7, delete “portion t and” and insert -- portion and --, therefor.

Signed and Sealed this
Seventeenth Day of February, 2015

Michelle K. Lee

Michelle K. Lee
*Deputy Director of the United States Patent and Trademark Office*